United States Patent [19]

Van Nieulande

[11] Patent Number: 4,784,713

[45] Date of Patent: Nov. 15, 1988

[54] APPARATUS AND METHOD FOR FORMING HAIRPIECES

[76] Inventor: Gilbert F. Van Nieulande, 23841 Kara Bay, Laguna Niguel, Calif. 92677

[21] Appl. No.: 135,836

[22] Filed: Dec. 21, 1987

[51] Int. Cl.[4] ..... B32B 31/04

[52] U.S. Cl. ..... 156/245; 156/498; 156/499; 156/500; 132/201

[58] Field of Search ..... 156/166, 177, 178, 180, 156/245, 498, 499, 500, 273.1, 379.6, 250, 511; 132/5, 56

[56] References Cited

U.S. PATENT DOCUMENTS

| | | | |
|---|---|---|---|
| 2,695,621 | 11/1954 | Cox | 132/56 |
| 3,081,780 | 3/1963 | Cramer | 132/56 |
| 3,580,761 | 5/1971 | Boultinghouse | 156/177 |
| 3,660,185 | 5/1972 | Bonham | 132/5 |
| 3,728,314 | 12/1955 | Richards | 132/56 |
| 4,422,230 | 12/1983 | Nemoto | 132/5 |

*Primary Examiner*—Caleb Weston

*Attorney, Agent, or Firm*—Poms, Smith, Lande & Rose

[57] ABSTRACT

Appartus and method for forming hairpieces including a plurality of tubes through which hair strands are passed and curl is applied to the strands. The lower ends of the strands are brought into contact with an alignment plate and, when all of the hair strands contact the plate, the plate is removed out of the path of the strands and the strands are moved into bonding contact with a membrane, the upper ends of the hair strands being cut to a predetermined length.

18 Claims, 3 Drawing Sheets

21
22
23
24
20
11
14
15
29
30
31
32
82'''
IV
37
40
40
83
82''
95
73
75
74
98
79
38
96
82
82'
78
77
76
39
41
41
99
100
33
34
35
97
80
46
47
V
V
45
42
36
44
48
45
43
84
200
50
51
52
53
56
54
55
201
110
111
49
61
58'
68'
70
84
58
60
58''
VI
VI
81
16
57
59
71
72

Fig. 5.
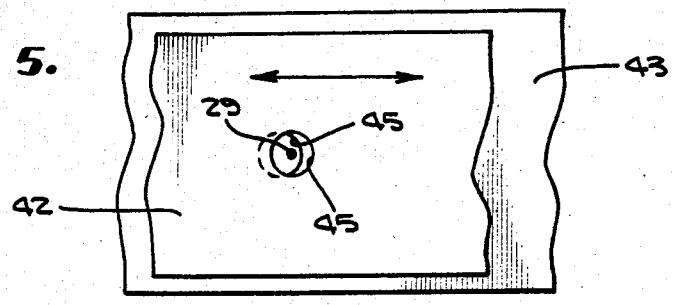
Fig. 7.
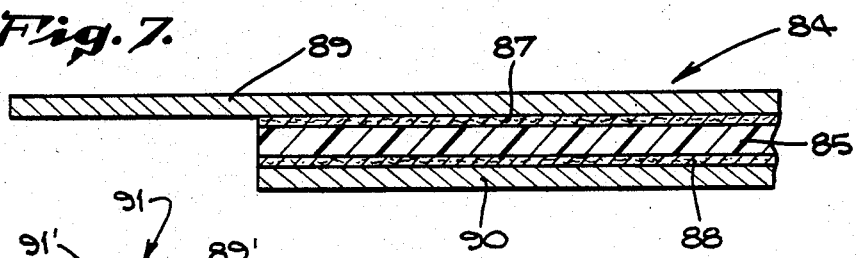
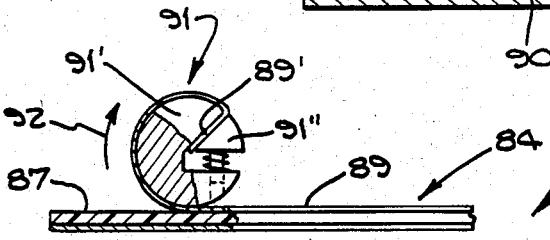
Fig. 8.
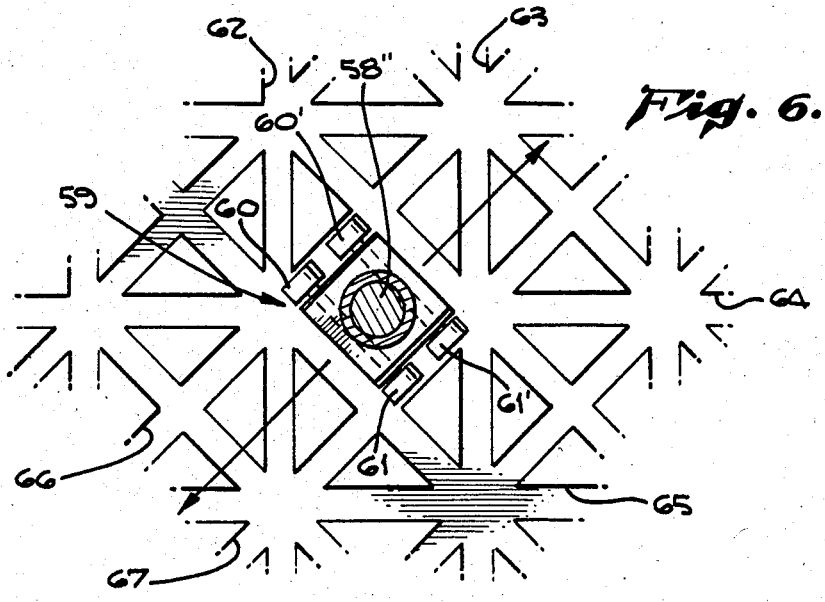
Fig. 6.

APPARATUS AND METHOD FOR FORMING HAIRPIECES

BACKGROUND OF THE INVENTION

1. Field of the Invention

The invention relates to the manufacture of hairpieces; and, more particularly, to apparatus and method for making human hairpieces.

2. Description of the Prior Art

Hairpieces for humans have been manufactured by various methods over the years. Many techniques have been used to make a hairpiece that is both natural and realistic. However, such techniques have heretofore been quite expensive, involving many man hours in the manufacture thereof. Further, the resulting hairpieces are very expensive, must be put on and taken off every day, are easy to detect because of differences in hair color, bulk, appearance, etc., and are constantly in need of service and repair. There is thus a big expense in upkeep, including tape or glue for adhering the hairpiece to the wearer's scalp, the aforementioned repairs and services, damage to the wearer's scalp by repeated taping and removal, etc.

There is thus a need for a hairpiece that is so inexpensive that it may be worn until removed, then disposed of. Such a hairpiece should be natural and realistic in appearance and require no servicing or taping or gluing between initial installation and subsequent removal. The hairpiece should also be comfortable to wear.

The method and apparatus contemplated herein in accordance with the invention contemplates the use of present day computer technology for making such a hairpiece, although, of course, manual techniques may be used where possible. In U.S. Pat. No. 2,695,621 to Cox, apparatus is disclosed for making wigs for dolls. Such wigs obviously do not have to be natural in appearance nor blended in with pre-existing hair. In the Cox patent, no curl is imparted to the hair strands nor is any attempt made to ensure uniform length thereto.

There thus exists a need for apparatus and method for forming natural and realistic looking hairpieces for humans which are so inexpensive that they can be disposable, if desired.

SUMMARY OF THE INVENTION

It is an object of this invention to provide apparatus and method for forming hairpieces for humans that are realistic and natural in appearance and inexpensive and disposable, if desired.

It is a further object of this invention to provide a disposable inexpensive hairpiece which is formed to the predetermined baldness pattern of the wearer.

It is still further an object of this invention to provide a hairpiece having a natural appearing curl in the hair strands.

These and other objects are preferably accomplished by providing a method and apparatus for forming hairpieces wherein the degree of curl, length, color and density of the normal hair of the recipient of the hairpiece is determined along with the pattern and dimensions of the portion of the scalp of the recipient of the hairpiece that it is desired to cover. A flexible ultra-thin membrane substantially conforming to the predetermined dimension having an adhesive surface on one side thereof normally covered by a removable nonadhesive material is placed between a mold and a pair of overlapping apertured plates, one of the plates having cutting edges surrounding its apertures with the apertures in one of the plates being normally coaxially aligned with the apertures in the other of the plates. A plurality of elongated strands of synthetic fiber conforming to the predetermined color and density are passed through a plurality of elongated tubes having coiled upper ends, the tubes having openings therethrough coaxially aligned with overlapping ones of the aligned apertures in the plates. An amount of heat relates to the predetermined degree of curl is applied to the coiled upper ends of the tubes while passing the strands therethrough. An amount of cooling related to the predetermined degree of curl is applied to the lower portions of the coiled upper ends thereby curling the same and effecting immediate molecular bonding to the membrane when the strands contact the membrane. The mold is moved in a plurality of directions while bringing the strands into contact with the membrane thereon for bonding the strands to the membrane in accordance with a first portion of the predetermined pattern. The spacing between the cutting plates and the mold can be varied to vary the hair length. One of the overlapping plates is moved laterally to cut the strands when the distance between adjacent surfaces of the overlapping plates and the surface of the membrane having the strands bonded thereto is at the predetermined length.

BRIEF DESCRIPTION OF THE DRAWINGS

FIGS. 4, 5 and 6 are views taken along lines IV—IV, V—V, VI—VI, respectively, of FIG. 2;

FIG. 7 is a cross-sectional view of a portion of a hairpiece base used to form a hairpiece in accordance with the invention; and FIG. 8 is an elevational view of a portion of the hairpiece base of FIG. 7 showing removal of the tape backing.

DESCRIPTION OF THE PREFERRED EMBODIMENT

Figure 1:
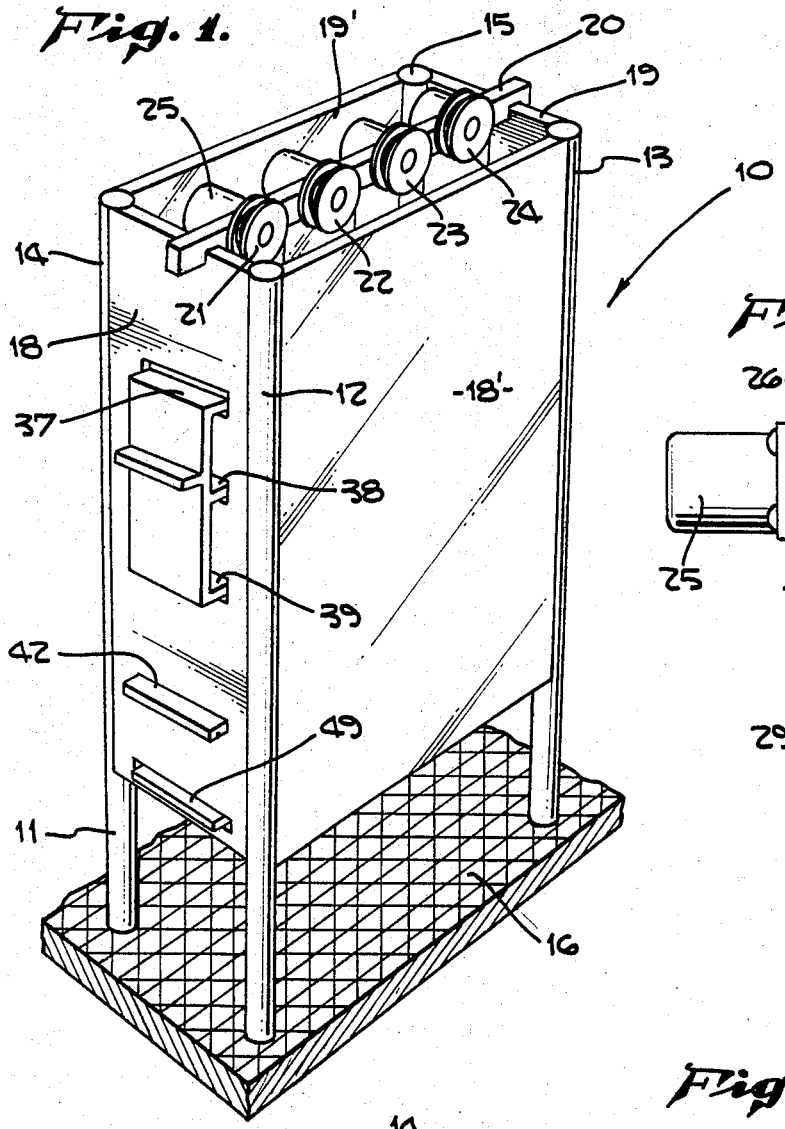
FIG. 1 is a perspective view of apparatus in accordance with the invention for carrying out the method of the invention.
Figure 2:
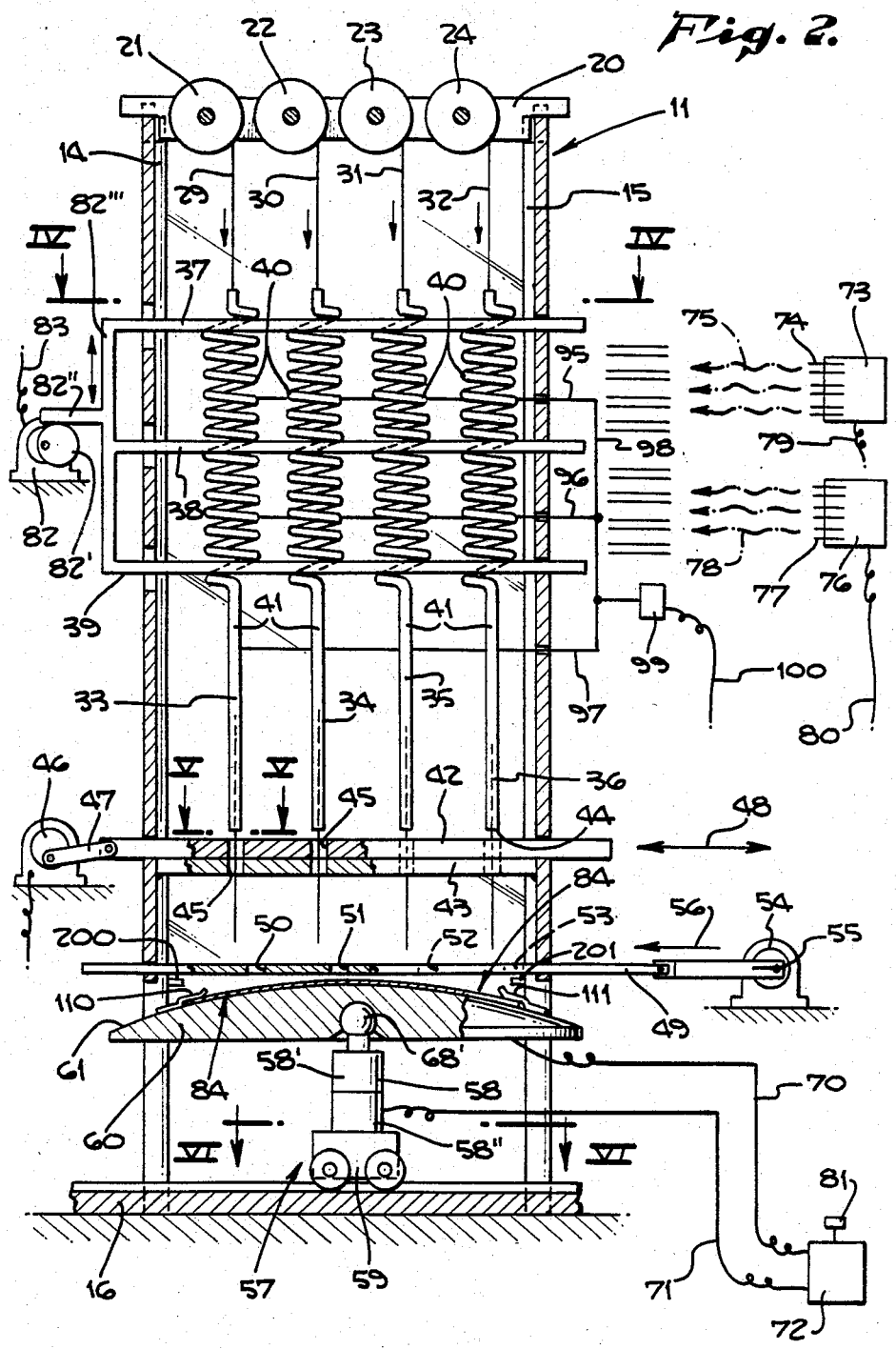
FIG. 2 is a vertically partly cross-sectional view of the interior of the apparatus in FIG. 1 showing in detail the inner components thereof.

Referring now to FIGS. 1 and 2 of the drawing, appartus 10 is shown having an upstanding framework 11 comprised of a plurality of vertical supports, such as front supports 12, 13 and rear supports 14, 15, extending upwardly from base 16. Thus, framework 11 is open but can of course be closed in or any other suitable arrangement to support the components illustrated in FIG. 2.

Figure 3:
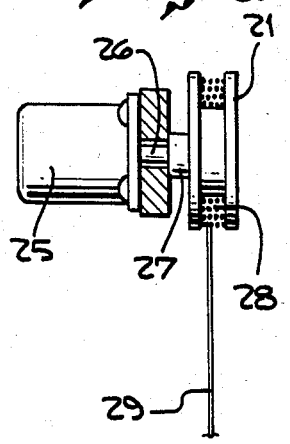
FIG. 3 is a detailed view partly in section, of one of the reels of the apparatus of FIGS. 1 and 2.

Side walls 18, 19 extend between supports 12, 14 and 13, 15, respectively. Front and rear walls 18', 19' may also be provided. These walls 18, 19, 18', 19' may be transparent, if desired. A support rod 20 is secured between walls 18, 19 and a plurality of reels or spools, such as reels 21, to 24, are secured to rod 20 and journalled for rotation thereon as seen in FIG. 3. A conventional magnetic stepping motor 25 rotates shaft 26 in short and essentially uniform angular movements. Shaft 26 is coupled to hub 27 of reel 21 to rotate the same. It is to be understood that each reel has a similar motor or, alternatively, a single motor can rotate a plurality of such shafts to rotate simultaneously the reels 21 to 24. The total number of reels is of course arbitrary.

Each reel is wound with elongated fiber strand material 28 providing strands leading downwardly therefrom (such as strands 29 through 32 leading downwardly from reels 21 to 24, respectively). Although any suitable synthetic fiber may be used, the material known as Kanekalon, which is manufactured and sold by Kanegafuchi Kagaku Kogyu Kabushiki Kaisha, d.b.a., Kanegafuchi Chemical Industry Co., Ltd. of Kitaku, Osaka, Japan is preferred. This material comes in different dimeters and fineness in the same batch of material.

Figure 4:
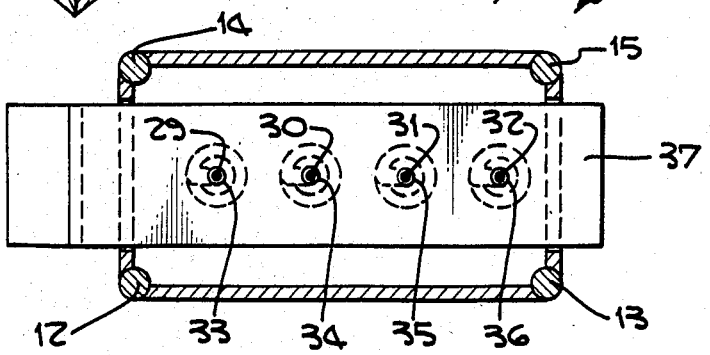

A plurality of elongated hollow tubes, such as tubes 33 to 36, related to the number of reels, are mounted spaced between horizontal support plates 37 through 39 also mounted on and between side walls 18, 19 as seen in FIGS. 1, 2 and 4.

These tubes are preferably made of stainless steel and, as seen in FIG. 2, are coiled at upper portions 40 between plates 37 and 39. The lower portions 41 below plate 39 are straight for reasons to be discussed.

A pair of stainless steel cutting plates 42, 43 are disposed below the terminal bottom ends 44 of tubes 33 to 36. The fibers 29 to 32 pass through normally aligned openings 45 in each plate 42, 43. One of the plates 42, 43 reciprocates with respect to the other. Thus, a conventional solenoid actuated motor 46 has its reciprocal link 47 fixed to top plate 42 and, upon actuation thereof, moves plate 42 back and forth in both horizontal directions as indicated by arrow 48. This can be seen in FIG. 5 wherein top plate 42 has been shifted slightly to the right with respect to lower plate 43, the fiber 29 passing through aligned openings 45. It is to be understood that the edges of openings 45 in plates 42, 43 are knife edges and, when plate 42 is moved further to the right in FIG. 5, fiber 29 is cut by the sharp knife edges of openings 45 thereby lopping off the ends of each fiber 29 to 32.

An alignment plate 49 is disposed below plates 42, 43 having apertures 50 to 53 therethrough. These apertures 50 to 53 are normally unaligned with the longitudinal axis of fibers 29 to 32 for reasons to be discussed. A solenoid motor 54, having a shaft 55 coupled to plate 49, is provided. Motor 54 is adapted, when actuated, to actuate shaft 55 to move plate 49 in the direction of arrow 56 until apertures 50 to 53 are aligned with strands 29 to 32 allowing the strands to pass therethrough for reasons to be discussed further hereinbelow.

A robotic mold assembly 57 is provided on base 16 having a pedestal 58 with a wheel assembly 59 at bottom movable over base 16, and provided at top with a mold 60. Pedestal 58 may be comprised of upper and lower telescoping sections 58' and 58'', respectively. Mold 60 has a convex or curved upper surface 61 and is preferably also of stainless steel. As seen in FIG. 6, wheel assembly 59 includes at least a plurality of wheels 60, 60', 61 and 61' movable along tracks mounted on base 16. For example, the wheels move forward and back along tracks 62, 63, right and left along tracks 64, 65 and diagonally along tracks 66, 67, etc., the wheels turning to accomplish the same, the specific mechanism being of any suitable type known in the robotic art.

A ball and socket joint 68' is provided between the upper end of pedestal 58 and its connection to mold 60. Suitable conduits 70, 71 electronically couple mold 60 and telescoping section 58' of pedestal 58, respectively, to a control panel 72. It is to be understood that control panel 72 is coupled to a source of power and may be coupled to the aforementioned motors so that all the operations of apparatus 10 may be controlled at panel 72. Suitable state-of-the-art electronics may be used to program all of the aforementioned activities and such forms no part of the invention other than in the environment described.

As seen in FIG. 2, steam generating means 73 is provided having outlets 74 emitting steam 75 into contact with the portions of tubes 33 to 36 between plates 37, 38. Any suitable steam generating means may be used. Cold air generating means 76 is provided having outlets 77 emitting cold air 78 into contact with those portions of tubes 33 to 36 between plates 38, 39. Any suitable cold air generating means may be used. Suitable conduits 79, 80 couple steam generating means 73 and cold air generating means 76 to control panel 72. It is to be understood that conventional temperature control and timing means 81 is associated with panel 72 for controlling the duration of steam and cold air generation and temperature thereof.

A conventional eccentric motor 82 is coupled to plates 37 to 39, plates 37 to 39 being tiltable about supports 12 to 15. Motor 82 has a camming portion 82' engaging the underside of extension portion 82'' coupled via an amfold 82''' to plates 37 to 39. Motor 82 is also coupled to panel 72 via conduit 83 and adapted to tilt plates 37 to 39 simultaneously and uniformly with respect to each other and simultaneously and in the same direction of tilt of mold 60. That is, when mold 60 is tilted about ball and socket joint 68', plates 37 to 39 are simultaneously tilted in the same direction. Mold 60 can thus be moved left and right, front to rear, diagonally, and tilt in any direction. Although only four tubes have been disclosed, obviously a substantially greater number is used for forming a hairpiece. For example, 600 to 1000 like tubes may be provided in a square pattern.

It is of course necessary to place a substrate material on the upper surface 61 of mold 60 prior to carrying out the hairpiece forming operations on the apparatus 10. Thus, as seen in FIG. 7, a hairpiece base or substrate assembly 84 is shown having a midsubstrate portion 85. This substrate portion 85 is a nonadhesive plastic portion, such as polyurethane, with suitable adhesive portions 87, 88 on each side thereof. A nonadhesive material 89 is disposed on the outer surface of adhesive layer 87 and a nonadhesive material 90 is disposed over adhesive layer 88. Layers 89, 90 may be of paper. Any suitable materials may be used, such as the Tegaderm material manufactured and sold by 3M of Minneapolis, Minn. Such a material is comprised of a strong, highly flexible polyurethane material coated with a hypoallergenic, water resistant, acrylate adhesive. It is sterile, transparent, impenetrable by water and bacteria, but permeable to moisture vapor and oxygen.

Base 84 is first placed on the upper surface 61 of mold 60. Outer layer 89 is removed either manually or by a clamp 91 (FIG. 8) attached to one side of backing 89. Thus, a rod 91' (shown in cross-section in FIG. 8) has a spring biased jaw 91'' clamping one end 89' of backing 89 therein grasping the same and moving in the direction of arrow 92 to peel off layer 89 exposing adhesive layer 87. In any event, such operation is not taken until the fiber strands 29 to 32 are about to be brought into contact with adhesive layer 87. Optionally, a liquid layer of the polyurethane material of layer 87, which is quick setting, may be applied to the upper surface of the layer 87 prior to bringing fiber strands 29 to 32 into contact therewith. This can be accomplished in any suitable manner, such as by sponging, brushing, spraying, etc. For example, as seen in FIG. 2, sprayers 200, 201, operated in any suitable manner, may be provided on framework 11 for spraying an adhesive on to layer 87.

In operation, the degree of curl, length, color and density of the normal hair of the recipient of the hairpiece is first determined. The pattern and dimensions of the portion of the scalp of the hairpiece recipient to be covered is also determined. This information is coded into the control panel 72 and the appropriate material 28 having the desired color and thickness is selected and reels 21 to 24 are either provided with such material 28 or preloaded reels 21 to 24 having such material 28 are loaded on apparatus 10.

Motors 25 are activated to rotate reels 21 to 24 paying out a predetermined length of fiber strands 29 to 32, such as 4 to 6 inches thereof. These strands 29 to 32 are fed into the upper ends of the coiled sections 40 of tubes 33 to 36 and held there (between plates 37 and 38) while steam 75 is applied thereto imparting a curl to the fiber strands 29 to 32. Simultaneously, cold air 78 is applied to coiled portions 40 between plates 38 and 39 and, when strands 29 to 32 are fed down tubes 33 to 36 in the cooled section, the cooling air 78 imparts a set resolution to the strands 29 to 32.

The strands continue down tubes 33 to 36 and exit out of open ends 44 through aligned apertures 45 in plates 42, 43 until the ends thereof abut against alignment plate 49. When all the strands abut against plate 49, plate 49 is actuated to move in the direction of arrow 56 aligning the strands with apertures 50–53 allowing the strands to pass therethrough and contact the adhesive layer 87 (backing layer 89 having been removed). The contact of the lower ends of strands 33 to 36 with adhesive surface 87 results in an immediate bonding thereto. Telescoping section 68' may be moved up or down to vary the distance from plates 42, 43, e.g., 3" to 4". Plate 42 is now activated via motor 46 to reciprocate with respect to plate 43 cutting the strands passing through aligned openings 45.

The alignment plate 49 brings all the strands to an even and level pattern ready for attachment when plate 49 is moved. As seen in FIG. 2, conduits 95 through 97 are coupled to tubes 33 to 36 in the heating, cooling and lower zones. These conduits 95 to 97 are coupled to a manifold 98 coupled to a conventional electrostatic generator 99 which, in turn, is coupled via conduit 100 to panel 72 and controlled thereby. Thus, an electrostatic charge can be applied to stainless steel tubes 33 to 36 and, thus, to the fiber strands within the tubes 33 to 36, to hold the strands against the inner walls of the tubes 33 to 36 at various stages in the process.

The mold 60 thus can move right, left, front, rear, diagonally, up or down, and tilt in any direction. The predetermined hair pattern is formed on the substrate 85. The backing layer 90 can be then peeled off exposing the adhesive and the hairpiece attached to the scalp of the wearer and cut to shape. Optionally, a coating of a moisture vapor permeable adhesive may be applied to the scalp of the wearer before attaching the hairpiece thereto.

The invention contemplates that the hairpiece so formed can be kept in place on the scalp of the user permanently, said for four weeks or so. The hairpiece can then be removed and a new one, formed as above, but in its place. The process disclosed herein is so inexpensive that the hairpiece formed can be disposable, if desired. Of course, the process can be used to form a permanent reusable hairpiece by omitting the layers 88, 90 and making substrate 85 thicker and of a stiffer material.

The temperature of the heating air 75 may be about 225° F. The temperature of the cooling air 78 may be about 35° F.

The approximate size of the section formed on substrate 85 in a single operation may be about 2-½ square inches. Thus, twenty such sections or so may be required to complete a single hairpiece. Robotic mold assembly 57 may be moved to a second station having similar apparatus 10 thereon and a second hair section placed thereon. Subsequent sections may be formed in like manner until the hairpiece is completed.

Any suitable tubing may be used. For example, the laser welded hypodermic needle stainless steel tubing manufactured by K-Tube Corp. of San Diego, Calif. under the trademark K-Tube may be used. Any suitable dimensions of tubing may be used, such as tubing having an ID of between about 0.0115" to 0.0130" and an OD of between about 0.0200" to 0.0205".

It can be seen that there is disclosed a method and apparatus for inexpensively forming a disposable hairpiece. This unique process brings a hairpiece within the bugdet of those who heretofore have been unable to afford them. A natural and realistic hairpiece is produced.

The process disclosed herein may be computer controlled and monitored to select the color, density (hairs per square inch) and curl factor of the recipient. The substrate 85 consists of an ultra-thin skin or film having moisture, vapor and permeable qualities. That is, the skin of the recipient can breathe and perspire normally while bacteria is kept away from the scalp. The substrate 85 adheres 100% to the scalp without need for added tape, glue or clips or any other fasteners. This of course eliminates an appreciable expense of wearing a hairpiece. The hairpiece is removed only once every four weeks or so, may be disposed of and replaced by a new unit, all for the cost of a normal hair styling. The adhesive layer 88 may be an acrylate polymer adhesive, such as the Tegaderm adhesive material, which is aggressively tacky, pressure sensitive, and relatively nonirritating to the skin in comparison with plasticized rubber-resin compositions and certain mixtures used in conventional double-sided hairpiece tape. The synthetic fibers are attached directly to the substrate without need for manual tieing or the like and molecularly bond thereto in about 10 to 50 seconds. This process eliminates a substantial portion (e.g., 95%) of normal labor cost in making hairpieces. Also, the elimination of visible knots makes for a more natural feeling and looking hairpiece.

The hairpiece formed by the process disclosed herein can be quickly and easily applied to the scalp of the recipient by any hair stylist with only minimal training, then cut and styled into the recipient's own hair in the same time, e.g., about 50 minutes, a normal hair styling would take place. The wearer can wear the hairpiece constantly until the next session, waking, sleeping, showering, swimming, etc. At the next session in four weeks or so, the old hairpiece may be removed and discarded and a new one put in its place.

Thus, an inexpensive hairpiece is provided that need not be put on and removed every day. Since a new one is used to replace the old one, fading and/or change in hair styling or coloring is not a problem. The hairpiece produced in accordance with the invention is light in weight and looks, natural in appearance, and eliminates the need for servicing and repairs. A comfortable and natural looking hairpiece is produced for the cost of a normal hair stylizing. It stays cleaner, does not mat, tangle or absorb odors, and holds its shape better than real hair. The adhesive attaching the hairpiece to the scalp of the recipient is a fully self-adhesive nonallergic breathable coating. The sectional approach to making the hairpiece heretofore disclosed allows one to vary the hair density and color blend depending on the effect desired.

Substrate 85, for a disposable hairpiece, may have a relatively thin preferred thickness; if it were desired to make a more permanent reusable hairpiece, it is only necessary to make substrate 85 of a stiffer and thicker material. One can then take off the resulting hairpiece, remove the old tape, put on new tape, and thus reuse it. In the manufacture thereof, the adhesive layer 88 and its coating 90 would not be necessary.

In all cases, the substrate assembly 84 (with or without layers 88 and 90) is held to the mold surface 61 in any suitable manner. For example, clamps or pins may be used. Alternatively, resiliently biased flanges or spaced lips 110, 111 (FIG. 2) may be provided on surface 61 and the substrate assembly 84 inserted therebetween and held to the mold 60. As discussed, these lip flanges 110, 111 may be separately mounted and resiliently biased by springs or the like or molded directly into the mold surface 61 and thus need not be resiliently biased.

It can be seen that there is disclosed a unique and novel way to make a hairpiece inexpensively and quickly. The hairpiece may be disposable and the invention is not to be limited by the foregoing description but only by the scope of the appended claims.

I claim:

1. Apparatus for forming a hairpiece comprising:

a plurality of space elongated hollow tubes mounted on a support, each of said tubes having an upper coiled end and a lower straight end;

heating means associated with the upper half of said coiled ends for applying heat thereto;

cooling means associated with the lower half of said coiled ends for applying cooling air thereto;

strand feed means on said support disposed above the upper ends of said hollow tubes associated with each of said tubes for feeding an elongated strand of a synthetic hair material down through each of said tubes;

cutting means disposed at the lower ends of said tubes having apertures therein coaxially aligned with the longitudinal axis of said tubes thereby allowing strands passing through said tubes to pass through said apertures and past said cutting means, said cutting means including cutting blades thereon adapted to cut said strands when said strands have moved therepast; and mold means disposed below said cutting means in the path of the lower ends of said tubes for retaining thereon a substrate conforming to the contour of the scalp of a hairpiece wearer whereby an adhesive surface may be applied to said substrate and strands of said material may be brought into contact with said substrate and molecularly bond thereto.

2. In the apparatus of claim 1 including an alignment plate disposed between said mold means and said cutting means having apertures therethrough normally coaxially unaligned with the lower open ends of said tubes whereby strands of material fed down through said tubes may abut against said plate.

3. In the apparatus of claim 2 including alignment plate moving means for moving said plate to a position coaxially aligning the apertures therethrough with the open ends of said tubes thereby permitting strands of material passing through said tubes to enter the apertures in said plate and contact said substrate.

4. In the apparatus of claim 1 including mold means moving means associated with said mold means for moving said mold means horizontally right to left, back to front, diagonally and tilting the same.

5. In the apparatus of claim 1 wherein the upper surface of said mold means is convex.

6. In the apparatus of claim 1 wherein said tubes are of stainless steel and electrostatic generating means is associated with said tubes for applying an electrostatic charge thereto.

7. In the apparatus of claim 1 wherein said cutting means includes a pair of overlapping cutting plates, the apertures therethrough having sharp cutting edges thereon and being normally coaxially aligned.

8. In the apparatus of claim 7 including cutting plate moving means for moving one of said cutting plates horizontally with respect to the other for cutting strands of material passing through the apertures in said cutting plates.

9. In the apparatus of claim 1 including space varying means associated with said cutting means for varying the distance between said cutting means and the mold means.

10. In the apparatus of claim 1 wherein said support includes tube tilting means thereon for tilting said tubes and said mold means includes mold tilting means associated therewith for tilting said mold means, said mold tilting means and said tube tilting means being simultaneous so that said tubes tilt in the same direction as said mold means tilts and at the same time.

11. In the apparatus of claim 1, including spraying means on said support adjacent said mold means for applying a spray of an adhesive material thereto.

12. In a method for forming a hairpiece comprising the steps of:

determining the degree of curl, length, color and density of the normal hair of the recipient of the hairpiece;

determining the pattern and dimensions of the portion of the scalp of the recipient of the hairpiece that it is desired to cover;

placing a flexible ultra-thin membrane substantially conforming to the predetermined dimension having an adhesive surface on one side thereof normally covered by a removable nonadhesive material between a mold and a pair of overlapping apertured plates having cutting edges surrounding said apertures with the apertures in one of said plates being normally coaxially aligned with the apertures in the other of said plates;

passing a plurality of elongated strands of synthetic fiber conforming to said predetermined color and density through a plurality of elongated tubes having coiled upper ends, said tubes having openings therethrough coaxially aligned with overlapping ones of said aligned apertures in said plates;

applying an amount of heat related to said predetermined degree of curl to the coiled upper ends of said tubes while passing said strands therethrough;

applying an amount of cooling related to said predetermined degree of curl to the lower portions of said coiled upper ends thereby curling the same and effecting immediate molecular bonding to said membrane when said strands contact said membrane;

moving said mold in a plurality of directions while bringing said strands into contact with said membrane thereon for bonding said strands to said membrane in accordance with a first portion of said predetermined pattern;

varying the distance between the mold and the overlapping plates in accordance with the predetermined length of said hair; and moving at least one of said overlapping plates laterally to cut said strands when the distance between adjacent surfaces of said overlapping plates and the surface of said membrane having said strands bonded thereto reaches said predetermined length.

13. In the method of claim 12 including the step of forming subsequent portions of said pattern on said membrane to complete said overall predetermined pattern.

14. In the method of claim 12 including the step of disposing a holding plate between said membrane and said overlapping plates prior to the step of bringing said strands into contact with said membrane so that said strands abut against said holding plate, and subsequently removing said holding plate out of the path of said strands and moving said strands into contact with said membrane so that all of said strands uniformly contact said membrane.

15. In the method of claim 12 including the step of applying an electrostatic charge to said strands while in said tubes so that said strands adhere to the inner walls of said tubes.

16. In the method of claim 12 wherein the step of applying an amount of heat includes the step of applying heat at a temperature of about 225° F.

17. In the method of claim 16 wherein the step of applying an amount of cooling includes the step of applying cooling air at a temperature of about 35° F.

18. In the method of claim 12 including the step of applying a liquid layer of an adhesive material to said adhesive surface prior to bringing said strands into contact with said membrane.

* * * * *